US007748326B2

(12) United States Patent
Simmons et al.

(10) Patent No.: US 7,748,326 B2
(45) Date of Patent: Jul. 6, 2010

(54) DOCKING STATION FOR RAIL TROLLEY

(75) Inventors: William R. Simmons, Brighton, MI (US); Eric Snyder, Sterling Heights, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 165 days.

(21) Appl. No.: 12/178,702

(22) Filed: Jul. 24, 2008

(65) Prior Publication Data

US 2010/0018433 A1 Jan. 28, 2010

(51) Int. Cl.
*B61B 3/00* (2006.01)

(52) U.S. Cl. ..... 104/91; 104/89; 104/249

(58) Field of Classification Search ..... 104/249, 104/250, 251, 252, 27, 28, 29, 89, 90, 91, 104/92, 93, 94; 188/38, 62; 198/679; 269/8
See application file for complete search history.

(56) References Cited

U.S. PATENT DOCUMENTS

| | | | | | |
|---|---|---|---|---|---|
| RE26,770 | E * | 1/1970 | Lemelson | 29/33 R |
| 3,854,889 | A * | 12/1974 | Lemelson | 29/33 P |
| 4,711,182 | A * | 12/1987 | Alexandrov et al. | 104/283 |
| 4,953,469 | A * | 9/1990 | Kuchta et al. | 104/127 |
| 5,450,796 | A * | 9/1995 | Sakagami | 104/89 |
| 5,562,041 | A * | 10/1996 | Ellens | 104/251 |
| 6,360,669 | B1 * | 3/2002 | Albrich | 104/93 |
| 6,550,392 | B2 * | 4/2003 | Albrich | 104/89 |
| 2002/0189488 | A1 * | 12/2002 | Ostrobrod | 104/91 |
| 2007/0089634 | A1 * | 4/2007 | Adam | 104/91 |
| 2007/0182953 | A1 * | 8/2007 | Tassic | 356/237.1 |
| 2008/0223248 | A1 * | 9/2008 | Schutte et al. | 104/124 |
| 2009/0008457 | A1 * | 1/2009 | Kilibarda | 235/475 |
| 2009/0193998 | A1 * | 8/2009 | Nishihara et al. | 104/91 |
| 2009/0274531 | A1 * | 11/2009 | Townson | 410/104 |

* cited by examiner

*Primary Examiner*—S. Joseph Morano
*Assistant Examiner*—Jason C Smith
(74) *Attorney, Agent, or Firm*—Quinn Law Group, PLLC

(57) ABSTRACT

A docking station for a monorail carrier system is provided. The carrier system includes a trolley that is configured to repositionably support a payload, and is adapted for interactive movement along a transfer bridge. The docking station includes a receiver plate having a rail-side portion perpendicularly oriented with a first interface portion that has one or more magnets attached thereto. A clamp assembly is attached to the rail-side portion, and operates to fasten the receiver plate to the transfer bridge at a predetermined location. The docking station also includes a docking plate having a trolley-side portion configured to securely attach to the trolley, and a second interface portion perpendicularly oriented with the trolley-side portion. The second interface portion is configured to magnetically cooperate with the first interface portion and thereby temporarily suspend the trolley at the predetermined location.

20 Claims, 2 Drawing Sheets

DOCKING STATION FOR RAIL TROLLEY

TECHNICAL FIELD

The present invention relates generally to rail-mounted trolley assemblies, and more particularly to devices for safely securing a repositionable rail-mounted trolley in a predetermined position.

BACKGROUND OF THE INVENTION

Trolley mounted hoists, overhead monorail carrier systems, and other similar conveyor apparatuses are frequently used in manufacturing plants, factory buildings, and other industrial operations to movably support instruments, tools, various materials, pre-assembled components, and a variety of other payloads. For example, in the automotive industry, overhead monorail carrier systems are used to repositionably support a wide range of tools (e.g., hoists, torque tubes, fastening equipment, etc.) at predetermined locations along engine, transmission, and vehicle assembly lines.

A typical overhead monorail carrier system will include a number of trolley devices (often referred to as a carrier or carriage), each extending downward from a corresponding overhead transfer bridge or rail. The bridge or rail system may be supported from an erected tubular column system, or from the ceiling, roof, or trusses of the building between adjacent rows of structural columns which support the roof or trusses. The transfer bridges are arranged in parallel along the assembly line, and spaced apart from one another. The floor space between the individual transfer bridges defines a number of work areas or storage spaces.

Each trolley is repositionable—i.e., slides or is slidable, from end-to-end along the transfer bridge, between adjacent rows of structural columns. The trolley normally comprises one or more wheels rotatably mounted to high-strength supporting plates (e.g., cast hardened or hardened alloy steel) by a complementary bearing. The wheels of the trolley roll along a transverse track, generally defined along the length of a cavity inside a hollow rail, or the inner flange surfaces of an I-beam bridge.

The hoists and equipment that is attached to the under hung bridges can unintentionally sway when the trolley is shifted from side-to-side. This may cause the trolley to inadvertently drift into the operator's way if not properly restrained. The most common way to restrain the trolley is via pneumatic or mechanical latching mechanisms, or by strapping the equipment to the nearest column by one or more bungee cords.

SUMMARY OF THE INVENTION

According to one embodiment of the present invention, a docking station for a carrier system is provided. The carrier system includes a trolley configured to repositionably support at least one payload. The trolley is adapted for operative interactive movement along a transfer bridge. The docking station includes a receiver plate member having a rail-side portion with a first interface portion extending therefrom. The rail-side portion is configured to securely attach to the transfer bridge at a predetermined location. The docking station also includes a docking plate member having a trolley-side portion with a second interface portion extending therefrom. The trolley-side portion is configured to securely attach to the trolley. One or more magnets is attached to one of the first and second interface portions. The other interface portion is configured to magnetically cooperate with the one or more magnets to thereby temporarily suspend the trolley at the predetermined location.

According to one aspect of the first embodiment, the docking station also includes a clamp assembly that is attached to the rail-side portion of the receiver plate member, and operable to fasten the receiver plate member to the transfer bridge. To this regard, the clamp assembly preferably includes a clamp member having a base portion with first and second flange portions each extending generally perpendicularly outward from an opposing end thereof. The first flange portion defines one or more threaded holes therethrough, each configured to receive and mate with a respective bolt. The bolts are operable to compress a portion of the transfer bridge against the second flange portion, and thereby lock the clamp member to the transfer bridge. It is further desirable that the rail-side portion of the receiver plate define at least one, but preferably two elongated channels therethrough, each channel being configured to receive a respective bolt. In this instance, the base portion of the clamp member defines one or more threaded holes, each configured to align with a respective elongated channel, and receive and mate with a respective one of the bolts to selectively repositionably secure the clamp member along the rail-side portion of the receiver plate member. Alternatively, the clamp member and receiver plate may be integrally formed as a single-piece member.

According to another aspect of this embodiment, each magnet consists essentially of a rare earth magnet.

In accordance with another aspect, the receiver plate member and the docking plate member are characterized by a lack of a mechanical interface when magnetically cooperating to temporarily suspend the trolley at the predetermined location.

According to yet another aspect of the first embodiment, the receiver plate member consists essentially of a metallic plate. In this instance, the first interface portion extends generally perpendicularly from a first end of the rail-side portion to define an L-shaped profile. Similarly, the docking plate member preferably consists essentially of a metallic plate, with the second interface portion extending generally perpendicularly from a first end of the trolley-side portion to define an L-shaped profile.

In accordance with another additional aspect, the aforementioned interface portion to which the magnets are to be attached defines one or more channels therethrough, each configured to receive a bolt. Accordingly, each magnet defines a threaded hole that is configured to receive and mate with a respective one of the bolts to thereby attach the magnet to the interface portion.

In accordance with yet another aspect of this embodiment, the trolley-side portion of the docking plate member defines first and second laterally spaced holes therethrough, each configured to receive a respective tightening bolt. The tightening bolts operate to press against the trolley and thereby selectively pivot the docking plate member relative to the trolley, eliminating any slack therebetween.

In another aspect, the docking plate member includes first and second laterally spaced ribs. Each rib extends between, and is attached to the trolley-side portion and the second interface portion and configured to reinforce the same.

In yet another aspect, the docking plate member includes first and second laterally spaced tabs. Each tab extends generally perpendicularly from opposite edges of the trolley-side portion, and is configured to align the docking plate member with the trolley for attachment thereto.

In accordance with yet another aspect of this embodiment, the trolley includes at least one swivel pin operatively attached thereto, and configured for attaching the at least one payload to the trolley. In this instance, the trolley-side portion of the docking plate member defines a hole therethrough that is configured to receive the swivel pin and thereby attach the docking plate member to the trolley.

According to another embodiment of the present invention, a docking station for an overhead monorail carrier system is provided. The monorail carrier system includes a trolley configured to repositionably support at least one payload, and is adapted for sliding interactive movement along an overhead transfer bridge. The docking station includes a receiver plate member having a rail-side portion with a first interface portion extending generally perpendicularly from a first end thereof. The first interface portion has at least one magnet operatively attached thereto. A clamp assembly is attached to the rail-side portion, and operates to securely fasten the receiver plate member to the transfer bridge at a predetermined location. The docking station also includes a single-piece metallic docking plate member having a trolley-side portion configured to securely attach to the trolley. A second interface portion extends generally perpendicularly from a first end of the trolley-side portion, and is oriented substantially parallel to the first interface portion. The second interface portion is positioned immediately adjacent the first interface portion when the trolley slides proximate to the predetermined location such that the second interface portion magnetically cooperates with the first interface portion to thereby temporarily retain the trolley at the predetermined location. The receiver plate member and the docking plate member are characterized by a lack of a mechanical interface when magnetically cooperating to temporarily retain the trolley at the predetermined location.

The above features and advantages, and other features and advantages of the present invention will be readily apparent from the following detailed description of the preferred embodiments and best modes for carrying out the invention when taken in connection with the accompanying drawings and appended claims.

DESCRIPTION OF THE PREFERRED EMBODIMENT

Figure 1:
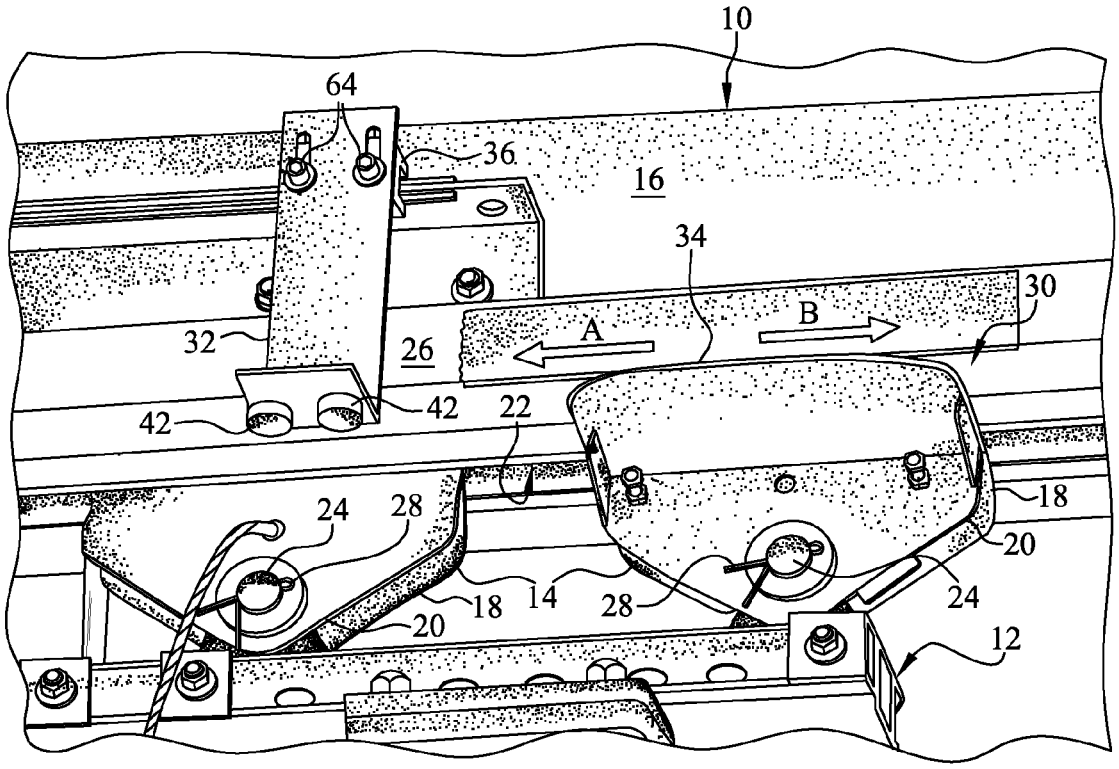
FIG. 1 is a perspective view illustration of an exemplary overhead monorail carrier system employing a trolley docking station in accordance with the present invention.

Referring to the drawings, wherein like reference numbers refer to like components throughout the several views, there is shown in FIG. 1 a representative overhead monorail carrier system, identified generally at 10, utilizing a docking station (also referred to herein as "trolley dock") in accordance with the present invention. The present invention is described herein with respect to the carrier system 10 of FIG. 1 as an exemplary application by which the present invention may be incorporated and practiced. As such, the present invention is by no means limited to the particular arrangement presented in FIG. 1. For example, the present invention may be used in overhead, wall mounted, and floor type carrier assemblies alike, and may be applied to monorail systems as well as systems with multi-rail mounted trolleys. In addition, the drawings presented herein—i.e., FIGS. 1 through 4, are not to scale and are provided purely for instructional purposes. Thus, the specific and relative dimensions shown in the drawings are not to be considered limiting.

A payload, indicated generally at 12 in FIG. 1, is shown supported by a pair of spaced, structurally identical trolleys 14, both of which are suspended from an overhead transfer bridge or rail 16. The payload 12 may comprise instruments, tools, various materials, pre-assembled components, etc., but is represented herein by an overhead hoist apparatus. Each trolley 14 is repositionable (e.g., slides or is slidable) from end-to-end along the transfer bridge 16, as represented by arrows A and B. Specifically, each trolley 14 includes a plurality of wheels (not shown) rotatably mounted to a rigid body, which is defined at least in part by first and second high-strength supporting plates 18 and 20, respectively, by a complementary bearing (not visible in FIG. 1). The wheels of the trolley roll along a transverse track, indicated generally at 22, which extends along the length of a cavity formed inside hollow rail portion 26. The payload 12 is hung from a pair of swivel pins 24, each of which passes transversely through a respective trolley 14, and is fixed in place by a locking tie 28. Although the transfer bridge 16 is illustrated in FIG. 1 as a stationary rail assembly having a substantially linear configuration, it should be recognized that the transfer bridge 16 may be a curved or endless rail, and may be of the movable rail assembly type without departing from the intended scope of the present invention.

Figure 2:
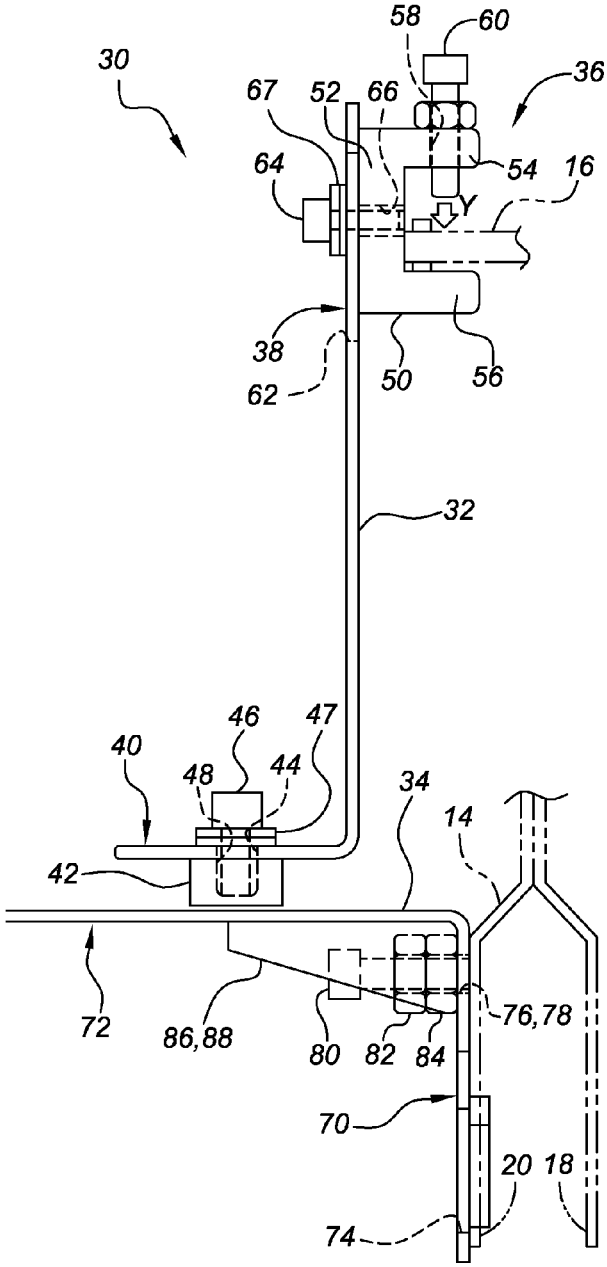
FIG. 2 is an enlarged side-view illustration of the trolley docking station of FIG. 1.

In order to selectively control the movement of the trolleys 14 and, specifically, to minimize unintentional sway or drifting of the trolleys 14 when shifted from side-to-side, a trolley docking station, indicated generally by reference numeral 30 in FIGS. 1 and 2, is integrated into the carrier system 10. The docking station 30 of the present invention consists primarily of two components: a receiver plate 32 and a docking plate 34, each configured to attach to or be integrated with a constituent part of the carrier system 10. Both the receiver plate 32 and docking plate 34 are preferably preformed, single-piece substantially rectangular plate members, each constructed from a material known to have a suitable strength for the intended use of the carrier system 10, such as, but not limited to, high-strength plastics (e.g., polyurethane, polyvinyl chloride, and polyethylene), metallic materials (e.g., cold rolled steel or aluminum), etc. It is also within the scope of the present invention that the plate members 32, 34 be fabricated from numerous constituent components that are assembled into a single, unitary structure. Moreover, the receiver plate 32 and docking plate 34 may individually or collectively take on additional functional shapes without departing from the scope of the present invention.

Referring now to FIG. 2, the receiver plate 32 has a rail-side portion, indicated generally at 38, with a first interface portion, indicated generally at 40, that extends generally perpendicularly from a first end thereof to form an L-shaped profile. The first interface portion 40 has at least one, but preferably two magnets 42 (see FIGS. 1 and 3) attached thereto. For example, the first interface portion 40 of the receiver plate 32 defines a number of channels therethrough, shown hidden in FIGS. 2 and 3 at 44. The channels 44, which preferably correspond in number to the number of magnets 42, are configured (i.e., sized) to receive a bolt 46. Correspondingly, each magnet 42 defines a threaded hole, shown hidden in FIGS. 2 and 3 at 48, that is configured to receive and mate (i.e., interlock threads) with a respective one of the bolts 46 to thereby attach the magnet 42 to the first interface portion 40. A washer 47 is disposed intermediate the bolt 46 and first interface portion 40. The magnets 42 are preferably permanent magnets, which may be of the ferrite, ticonal, or alnico type, but preferably consist of rare earth magnets.

The rail-side portion 38 of the receiver plate 32 is configured to securely attach to the transfer bridge 16 at a predetermined location (which may also be referred to as "home position" or "safety position"). By way of example, the receiver plate 32 may be attached to the transfer bridge 16 by adhering, fastening or welding the rail-side portion 38 directly thereto. According to preferred practice, however, the docking station 30 includes a clamp assembly 36 that is operable to fasten the receiver plate 32 to the transfer bridge 16. To this regard, the clamp assembly 36 includes a clamp member 50 having a base portion 52 with first and second flange portions 54 and 56, respectively, each extending generally perpendicularly outward from an opposing end thereof. The first flange portion 54 defines one or more threaded holes therethrough, shown hidden in FIGS. 2 and 3 at 58. Each threaded hole 58 is configured (i.e., threaded and sized) to receive and mate with a respective bolt 60 (only one of which is visible in the drawings). The bolts 60 are operable to travel vertically (illustrated in FIG. 2 for explanatory purposes by arrow Y) to compress a portion of the transfer bridge 16 against the second flange portion 56, and thereby lock the clamp member 50 and, thus, the receiver plate 32 to the transfer bridge 16.

Figure 3:
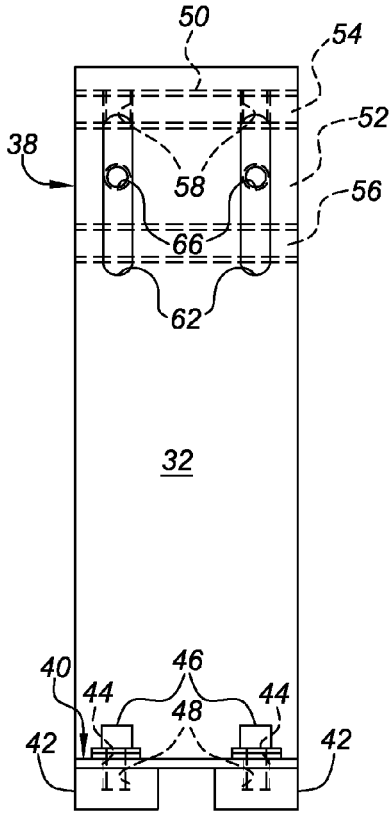
FIG. 3 is a front-view illustration of the receiver plate of FIG. 1.

According to the embodiment of FIGS. 2 and 3, the rail-side portion 38 of the receiver plate 32 defines at least one, but preferably two elongated channels 62 therethrough. Each of the elongated channels 62 is configured (i.e., sized and contoured) to receive a respective bolt 64. Likewise, the base portion 52 of the clamp member 50 defines a number of threaded holes, show hidden in FIG. 2 at 66, corresponding in number to the number of elongated channels 62. Each of the threaded holes 66 is configured (i.e., threaded, sized, and oriented) to align with a respective elongated channel 62, and receive and mate with a respective one of the bolts 64. A washer 67 is disposed intermediate the bolt 64 and rail-side portion 38. The clamp assembly 36 may be selectively repositioned and secured at various locations along the rail-side portion 38 of the receiver plate 32 by loosening the bolts 64, sliding the clamp member 50 up or down along the vertically elongated channels 62, and retightening the bolts 64. As an alternative, the clamp member 50 and receiver plate 32 may be integrally formed as a single-piece member.

Figure 4:
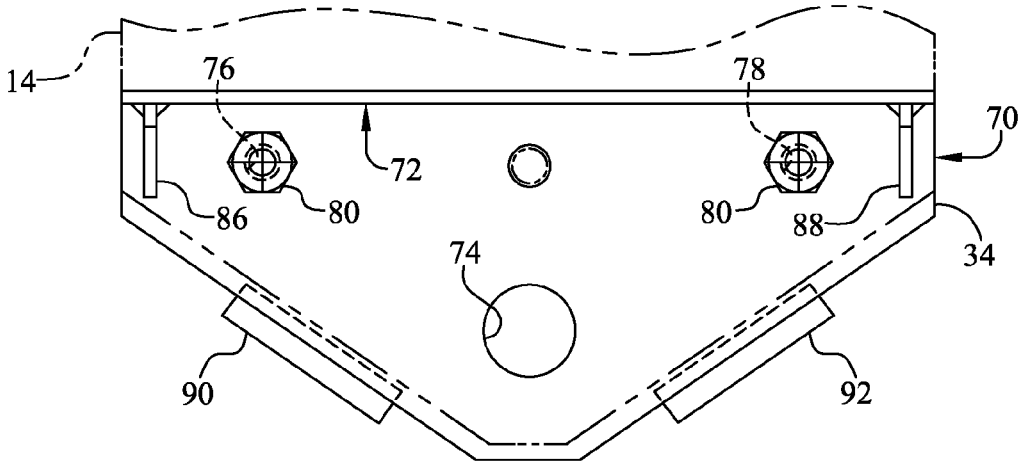
FIG. 4 is a front-view illustration of the docking plate of FIG. 1.

Looking now at FIGS. 2 and 4, the docking station also includes a docking plate 34 having a trolley-side portion, indicated generally at 70, with a second interface portion, indicated generally at 72, which extends generally perpendicularly from a first end thereof to form an L-shaped profile. The second interface portion 72 is oriented substantially parallel to the first interface portion 40 of the receiver plate 32. The trolley-side portion 70 of the docking plate 34 is configured to securely attach to the trolley 14. Specifically, the trolley-side portion 70 of the docking plate 34 defines a swivel pin hole 74 therethrough that is configured to receive a respective one of the swivel pins 24, which is fixed in place by locking tie 28, thereby attaching the docking plate 34 to the trolley 14. As such, the docking plate 34 can be integrated into the carrier system 10 without any modification to the constituent parts thereof.

Ideally, the trolley-side portion 70 of the docking plate 34 defines first and second laterally spaced holes therethrough, shown hidden in FIGS. 2 and 4, and identified by reference numerals 76 and 78, respectively. Each of the laterally spaced holes 76, 78 is configured to receive a respective tightening bolt 80. First and second nuts 82 and 84, respectively, are disposed between the tightening bolts 80 and the trolley-side portion 70 of the docking plate 34. The second nut 82 is preferably welded to the trolley-side portion 70, providing a threaded passage for translating the tightening bolt 80 with respect to the docking plate 34. In this regard, the tightening bolts 80, when rotated clockwise, operate to press against the trolley 14, such as second supporting plate 20, and thereby selectively pivot the docking plate 34 relative to the trolley 14 (i.e., about swivel pin 24), eliminating any slack therebetween.

The docking plate 34 also includes first and second laterally spaced ribs 86 and 88, respectively. Each rib 86, 88 extends between the trolley-side portion 70 and the second interface portion 72, in a generally perpendicular manner. The first and second laterally spaced ribs 86, 88 are attached to both the trolley-side portion 70 and second interface portion 72, thereby reinforcing the same.

Also shown in FIGS. 2 and 4 are first and second laterally spaced tabs 90 and 92, respectively. Each tab 90, 92 extends generally perpendicularly from laterally opposite edges of the trolley-side portion 70, and is configured to align the docking plate 34 with the trolley 14 for attachment thereto. That is, the first and second tabs 90, 92 are dimensioned and oriented such that when they are pressed against complementary edges of the trolley 14 (i.e., second supporting plate 20), the swivel pin hole 74 will properly align to receive a respective swivel pin 24. Moreover, the first and second tabs 90, 92 are preferably sufficiently rigid to thereafter limit any rotational movement of the docking plate 34 about the swivel pin 24 by abutting against rotationally counteracting edges of the second supporting plate 20.

The second interface portion 72 of the docking plate 34 is configured to magnetically cooperate with the first interface portion 40 of the receiver plate 32 and thereby temporarily suspend the trolley 14 at the predetermined location (or home position). Specifically, the trolley 14 and docking plate 34 can move freely along the transfer bridge 16. When the trolley 14 slides proximate to the predetermined location (i.e., where the receiver plate 32 is selectively positioned), the second interface portion 72 is positioned immediately adjacent the first interface portion 40 (as seen in FIG. 2). When properly oriented, the second interface portion 72 magnetically cooperates with the first interface portion 40 to thereby temporarily retain the trolley at the predetermined location. By way of example, the second interface portion 72 may be fabricated from a metallic material known to have a strong magnetic attraction to the magnets 42 extending from the bottom of the receiver plate 32. Alternatively, one or more oppositely polarized magnets (not shown) may be attached to the second interface surface 72 of the docking plate 34. Thereafter, when the trolley 14 is moved away from the predetermined location (i.e., the portion of the transfer bridge where the receiver plate 32 is attached), the magnets 42 will magnetically shear from the second interface surface 72. The receiver plate 32 and docking plate 34 are preferably characterized by a lack of a mechanical interface when magnetically cooperating to temporarily suspend the trolley 14 at the predetermined location. As such, the trolley dock 30 requires little or no maintenance, as would a latching device, pneumatic device, or other docking station requiring a mechanical interface.

While the best modes for carrying out the present invention have been described in detail, those familiar with the art to which this invention relates will recognize various alternative designs and embodiments for practicing the invention within the scope of the appended claims.

The invention claimed is:

1. A docking station for a carrier system including a trolley configured to repositionably support at least one payload and adapted for operative interactive movement along a transfer bridge, the docking station comprising:

a receiver plate member having a rail-side portion with a first interface portion extending therefrom, said rail-side portion configured to securely attach to the transfer bridge at a predetermined location;

a docking plate member having a trolley-side portion with a second interface portion extending therefrom, said trolley-side portion configured to securely attach to the trolley; and at least one magnet operatively attached to one of said first and second interface portions;

wherein the other of said first and second interface portions is configured to magnetically cooperate with said at least one magnet to thereby temporarily suspend the trolley at said predetermined location.

2. The docking station of claim 1, further comprising:

a clamp assembly operatively attached to said rail-side portion of said receiver plate member and operable to fasten said receiver plate member to the transfer bridge.

3. The docking station of claim 2, wherein said clamp assembly includes a clamp member having a base portion with first and second flange portions each extending generally perpendicularly outward from an opposing end thereof, said first flange portion defining a first threaded hole therethrough configured to receive and mate with a first bolt operable to compress a portion of the transfer bridge against said second flange portion.

4. The docking station of claim 3, wherein said rail-side portion defines an elongated channel therethrough configured to receive a second bolt, and wherein said base portion defines a second threaded hole configured to align with said elongated channel and receive and mate with said second bolt to selectively repositionably secure said clamp member along said rail-side portion.

5. The docking station of claim 3, wherein said clamp member and said receiver plate member are integrally formed as a single-piece member.

6. The docking station of claim 1, wherein said at least one magnet consists essentially of a rare earth magnet.

7. The docking station of claim 1, wherein said receiver plate member and said docking plate member are characterized by a lack of a mechanical interface when said other of said first and second interface portions is magnetically cooperating with said at least one magnet to temporarily suspend the trolley at said predetermined location.

8. The docking station of claim 1, wherein said receiver plate member consists essentially of a metallic plate, said first interface portion extending generally perpendicularly from a first end of said rail-side portion to define an L-shaped profile.

9. The docking station of claim 1, wherein said docking plate member consists essentially of a metallic plate, said second interface portion extending generally perpendicularly from a first end of said trolley-side portion to define an L-shaped profile.

10. The docking station of claim 1, wherein said other of said first and second interface portions defines at least one channel therethrough configured to receive a third bolt, and wherein said at least one magnet defines a third threaded hole configured to receive and mate with said third bolt to thereby attach said at least one magnet to said other of said first and second interface portions.

11. The docking station of claim 1, wherein said trolley-side portion of said docking plate member defines first and second laterally spaced holes therethrough each configured to receive a respective tightening bolt operable to press against the trolley and thereby selectively pivot said docking plate member relative to the trolley.

12. The docking station of claim 1, wherein said docking plate member includes first and second laterally spaced ribs extending between and attached to said trolley-side portion and said second interface portion and configured to reinforce the same.

13. The docking station of claim 1, wherein said docking plate member includes first and second laterally spaced tabs extending generally perpendicularly from said trolley-side portion and configured to align said docking plate member with the trolley for attachment thereto.

14. The docking station of claim 1, wherein the trolley includes at least one swivel pin operatively attached thereto and configured for attaching the at least one payload thereto, and wherein said trolley-side portion defines a hole therethrough configured to receive the swivel pin and thereby attach said docking plate member to the trolley.

15. A docking station for a monorail carrier system including a trolley configured to repositionably support at least one payload and adapted for operative interactive movement along a transfer bridge, the docking station comprising:

a receiver plate member having a rail-side portion oriented generally perpendicularly with a first interface portion having at least one magnet operatively attached thereto;

a clamp assembly operatively attached to said rail-side portion and operable to securely fasten said receiver plate member to the transfer bridge at a predetermined location; and a docking plate member having a trolley-side portion configured to securely attach to the trolley, and a second interface portion oriented generally perpendicularly with said trolley-side portion and configured to magnetically cooperate with said first interface portion of said receiver plate and thereby temporarily suspend the trolley at said predetermined location;

wherein said receiver plate member and said docking plate member are characterized by a lack of a mechanical interface when magnetically cooperating to temporarily suspend the trolley at said predetermined location.

16. The docking station of claim 15, wherein said clamp assembly includes a clamp member having a base portion with first and second flange portions each extending generally perpendicularly outward from an opposing end thereof, said first flange portion defining a first threaded hole therethrough configured to receive and mate with a first bolt operable to compress a portion of the transfer bridge against said second flange portion.

17. The docking station of claim 16, wherein said rail-side portion defines an elongated channel therethrough configured to receive a second bolt, and wherein said base portion defines a second threaded hole configured to align with said elongated channel and receive and mate with said second bolt to selectively repositionably secure said clamp member along said rail-side portion.

18. The docking station of claim 15, wherein said trolley-side portion of said docking plate member defines first and second laterally spaced holes therethrough each configured to receive a respective tightening bolt operable to press against the trolley and thereby selectively pivotably reorient said docking plate member relative to the trolley.

19. The docking station of claim 15, wherein said docking plate member includes first and second laterally spaced tabs extending generally perpendicularly from said trolley-side portion and configured to align said docking plate member with the trolley for attachment thereto.

20. A docking station for a monorail carrier system including a trolley configured to repositionably support at least one payload and adapted for sliding interactive movement along an overhead transfer bridge, the docking station comprising:

a receiver plate member having a rail-side portion with a first interface portion extending generally perpendicularly from a first end thereof, said first interface portion having at least one magnet operatively attached thereto;

a clamp assembly operatively attached to said rail-side portion and operable to securely fasten said receiver plate member to the transfer bridge at a predetermined location; and a single-piece metallic docking plate member having a trolley-side portion configured to securely attach to the trolley, and a second interface portion extending generally perpendicularly from a first end of said trolley-side portion and oriented substantially parallel to said first interface portion;

wherein said second interface portion is positioned immediately adjacent said first interface portion when the trolley slides proximate to the predetermined location such that said second interface portion magnetically cooperates with said first interface portion to thereby temporarily retain the trolley at said predetermined location; and wherein said receiver plate member and said docking plate member are characterized by a lack of a mechanical interface when magnetically cooperating to temporarily retain the trolley at said predetermined location.

* * * * *